US010364589B2

(12) United States Patent
Cochrane

(10) Patent No.: US 10,364,589 B2
(45) Date of Patent: Jul. 30, 2019

(54) BARRIER

(71) Applicant: Cochrane Steel Products (PTY) Ltd., Kempton Park (ZA)

(72) Inventor: Alexander Richard Cochrane, Kempton Park (ZA)

(73) Assignee: COCHRANE STEEL PRODUCTS (PTY) LTD, Kempton Park (ZA)

( * ) Notice: Subject to any disclaimer, the term of this patent is extended or adjusted under 35 U.S.C. 154(b) by 0 days.

(21) Appl. No.: 15/932,438

(22) Filed: Feb. 7, 2017

(65) Prior Publication Data

US 2018/0283042 A1 Oct. 4, 2018

(30) Foreign Application Priority Data

Apr. 13, 2016 (ZA) ..... 201602486

(51) Int. Cl.
*E04H 17/24* (2006.01)
*E04H 17/16* (2006.01)

(52) U.S. Cl.
CPC ..... *E04H 17/161* (2013.01); *E04H 17/24* (2013.01)

(58) Field of Classification Search
CPC ..... E04H 17/00; E04H 17/16; E04H 17/161; E04H 17/24
See application file for complete search history.

(56) References Cited

U.S. PATENT DOCUMENTS 4,553,740 A * 11/1985 Bailey ..... E04H 17/161 256/33
4,673,166 A * 6/1987 MacDougall ..... E04H 17/02 256/1
5,542,649 A * 8/1996 Allegaert ..... E04H 17/003 256/32
5,556,080 A * 9/1996 Vise ..... E04H 17/003 248/74.5
6,113,076 A * 9/2000 Hancock-Bogese ..... A01K 3/00 256/1
6,199,831 B1 * 3/2001 Patrick ..... A01K 3/00 256/11
6,206,347 B1 * 3/2001 Kelley ..... E04H 17/003 256/1
6,581,914 B2 * 6/2003 Saura Sotillos ..... E04H 17/161 256/35
7,118,096 B2 * 10/2006 Petrozziello ..... A01K 3/00 256/32
D605,781 S * 12/2009 Cochrane ..... D25/45
9,428,934 B1 * 8/2016 Payne ..... E04H 17/161
2004/0004210 A1 * 1/2004 Bauer ..... A01M 1/04 256/32
2007/0170411 A1 * 7/2007 Ribak ..... E01F 13/022 256/32
2015/0292170 A1 * 10/2015 Cochrane ..... E01F 13/022 256/13.1
2018/0058094 A1 * 3/2018 Filiba ..... E06B 9/02

* cited by examiner

*Primary Examiner* — Daniel J Wiley
(74) *Attorney, Agent, or Firm* — Tutunjian & Bitetto, P.C.

(57) ABSTRACT

A barrier which includes a first mesh panel with spaced horizontally extending reinforcing formations, and a second mesh panel positioned between two of the reinforcing formations.

7 Claims, 12 Drawing Sheets

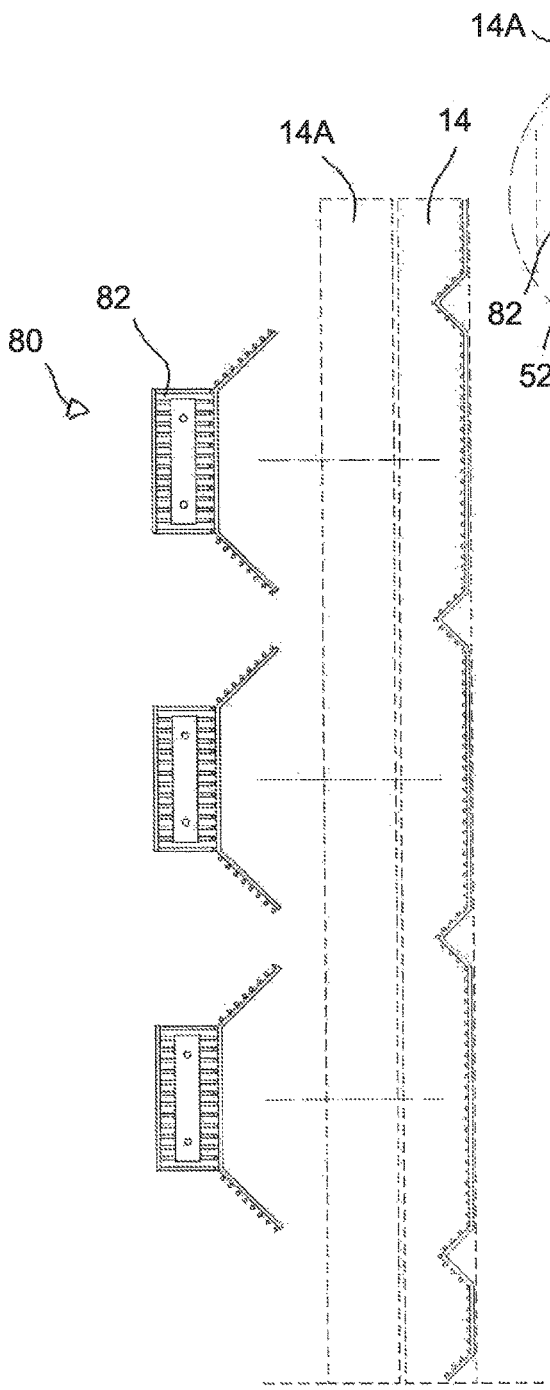
FIG. 5
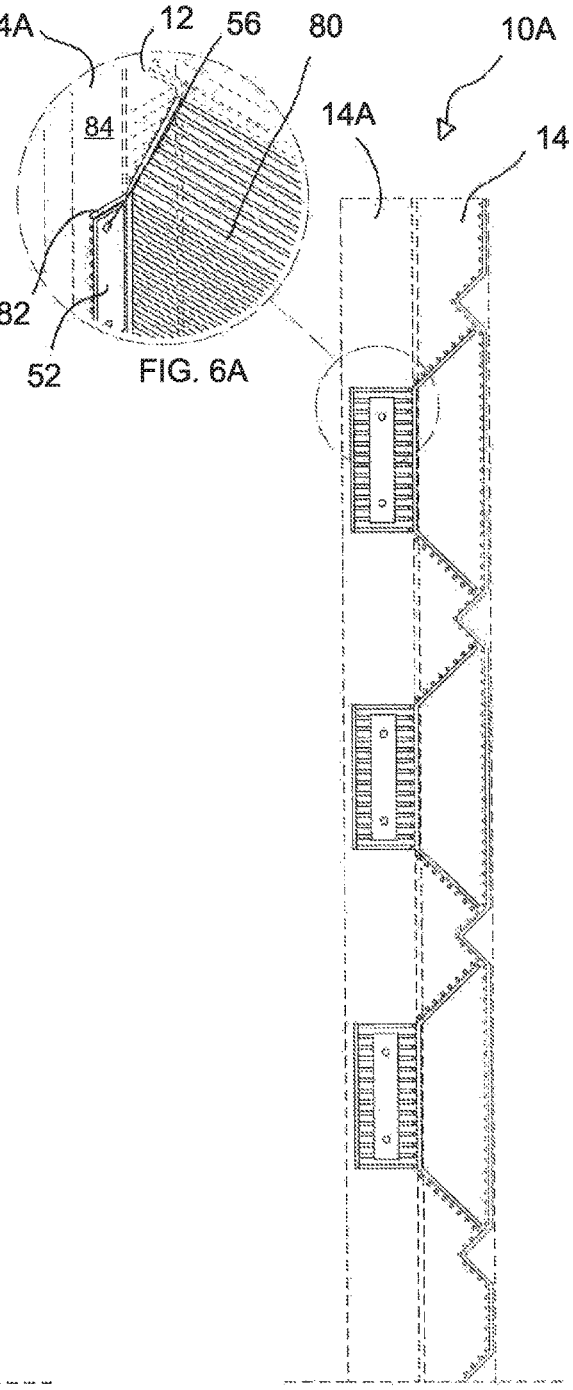
FIG. 6A
FIG. 6

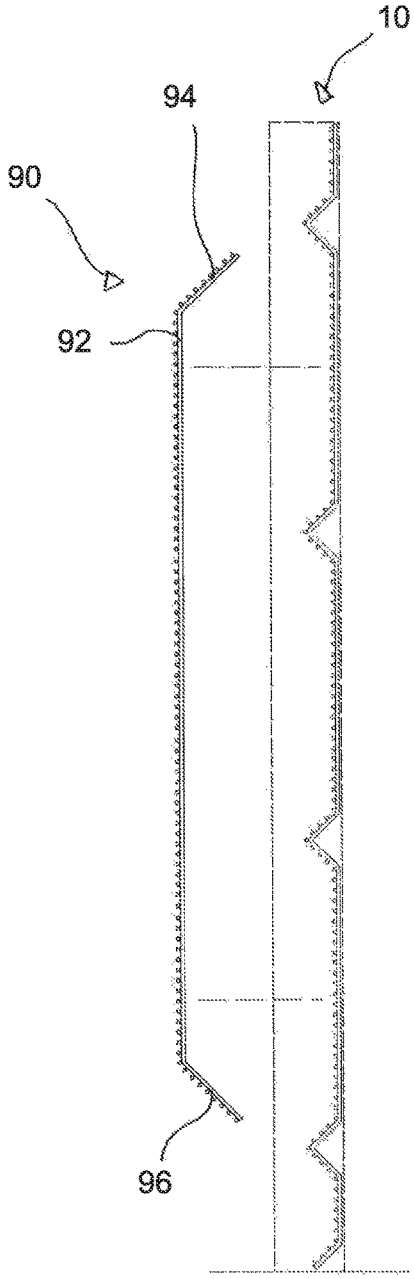
FIG. 7
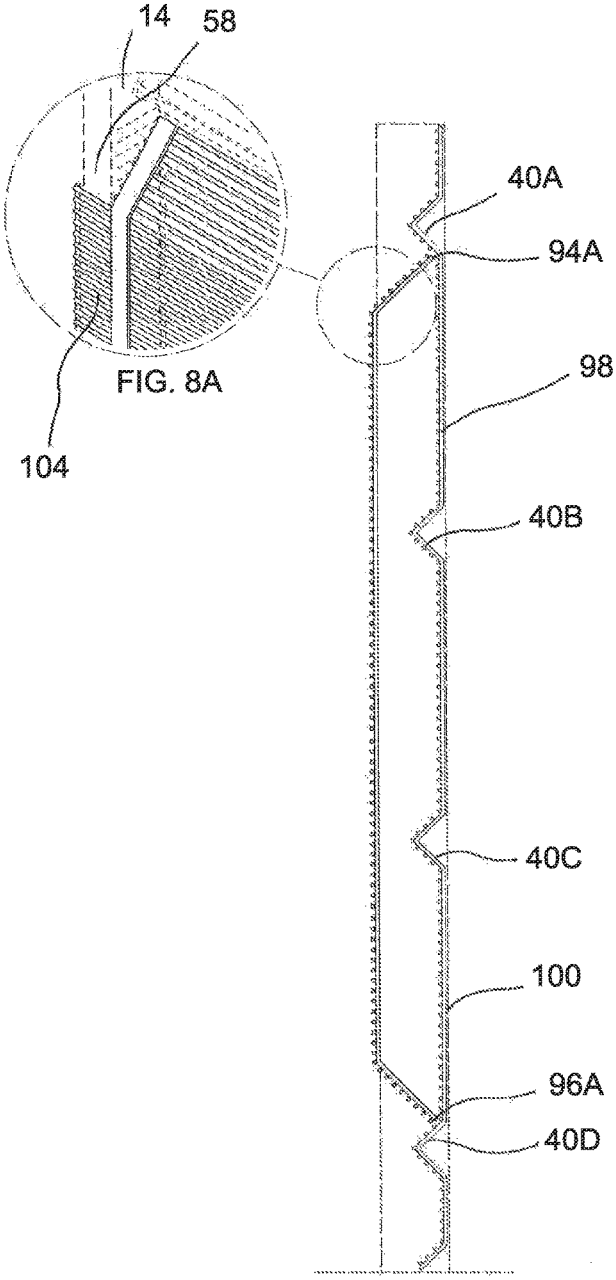
FIG. 8A
FIG. 8

BARRIER

BACKGROUND

This invention relates to a physical barrier or fence.

One type of barrier makes use of a high density steel mesh. Typically, mesh panels are prefabricated under factory conditions and each panel is secured between and to an adjacent pair of posts which have lower ends embedded in the ground. Each panel is normally stiffened to prevent undue flexure of the panel by forming the panel with at least one horizontally extending reinforcing channel which, in cross section, is U-shaped or V-shaped. The channel is defined by bending appropriate portions of rods which make up the mesh.

The security rating which is provided by a fence may initially be adequate but, in many instances, due to a variety of factors, a higher security rating may be required of a fence after it has been erected. It is desirable for cost and other reasons to be able to upgrade a fence to achieve an acceptable degree of security, as opposed to erecting, from scratch, a separate fence. It is also desirable to be able to erect a fence which, ab initio, has a high security rating.

An object of the present invention is to address, to at least some extent, the aforementioned factors.

SUMMARY

The invention provides a barrier which includes a plurality of elongate vertically extending supports which are respectively spaced apart from one another along a barrier line, a plurality of first mesh panels, wherein a respective first mesh panel is secured to and extends between a first support and an adjacent second support of the plurality of supports, the first mesh panel including first and second vertically extending edges fixed respectively to the first and second supports and upper and lower horizontally extending edges, and in respect of each said first mesh panel, a respective deterrent structure which is fabricated separately from the first mesh panel, which opposes at least a part of the first mesh panel and which is secured to at least one of the first mesh panel, and the first and second supports.

The deterrent structure is used to enhance the capability of the barrier, between the first and second supports, to resist attack.

The first mesh panel may include a plurality of horizontally extending reinforcing formations, which are vertically spaced apart from one another, wherein each formation, in cross-section, generally has a V- or U-shape.

The deterrent structure may take on any appropriate form determined primarily by the degree of additional attack resistance which is required for the barrier. Thus the deterrent structure may, in one form of the invention, include at least a second mesh panel which is positioned between two of the aforementioned horizontally extending reinforcing formations. In one form of the invention these reinforcing formations are adjacent each other. Each of a plurality of the second mesh panels may be positioned between a respective adjacent pair of the horizontally extending reinforcing formations.

In a different form of the invention a second mesh panel is secured in position adjacent the first mesh panel between first and second said horizontally extending reinforcing formations in the first mesh panel and the second mesh panel overlies at least one said horizontally extending reinforcing formation in the first mesh panel.

In another form of the invention the deterrent structure comprises a plurality of spaced lengths of flat bar secured in position adjacent the first mesh panel between a first said horizontally extending reinforcing formation in the first mesh panel and a second said horizontally extending reinforcing formation in the first mesh panel. The said plurality of lengths of flat bar may extend vertically, or horizontally, or vertically and horizontally.

In a variation of the invention the deterrent structure comprises a framework made from a plurality of opposing tubular members, e.g. of square or rectangular cross-section positioned adjacent the first mesh panel and extending between two of said horizontally extending reinforcing formations in the first mesh panel.

The first mesh panel may include a first array of elongate members which are positioned spaced apart from one another and which extend generally horizontally, and a second array of vertically extending members which are spaced apart from one another and which extend generally vertically and wherein the first array is positioned so that it overlies the second array and the elongate members of the first array are welded to the elongate members of the second array at respective points of contact.

The horizontally extending members may have a first spacing between adjacent pairs of the members and the vertically extending members may have a second spacing between adjacent pairs of the members which is greater than the first spacing.

The horizontally extending members may be of any suitable form and for example are made from round bar, wire or rod of a circular cross section or the like. In one form of the invention the vertically extending members include or comprise a plurality of flat bar elements. A significant benefit associated with the use of the flat bar elements lies in the fact that a flat bar is difficult to cut with a bolt cutter or a similar instrument.

In one form of the invention the deterrent structure includes a plurality of tubular members which are respectively filled with an attack-resistant material such as a cementitious or ceramic material, an ultra-hard settable material or the like.

If the deterrent structure presents at least one upwardly facing surface adjacent the first mesh panel that surface should be inclined so that it does not readily provide a foothold or a handhold for an intruder who is attempting to scale the barrier.

To enhance the strength of the barrier a third support of the plurality of supports may be located adjacent the first support and a fourth support of the plurality of supports may be located adjacent the second support.

Each support of said plurality of supports may include at least one vertically extending member which may be tubular. To increase the strength of the barrier each of the supports may comprise at least two of the vertically extending tubular members which, optionally, are substantially identical to each other in cross-section. The vertically extending members may be secured to each other in any appropriate way, eg. by means of welding or through the use of suitable fasteners.

In one form of the invention each support comprises a respective tubular member which is braced by means of a stay or a web to enhance its strength and load-bearing capability.

Each support may comprise a respective tubular member which is filled with concrete or any other suitable settable material and, optionally, at least one longitudinally extending reinforcing member is embedded in the concrete or settable material.

BRIEF DESCRIPTION OF THE DRAWINGS

The invention is further described by way of examples with reference to the accompanying drawings in which:

FIGS. 5, 6 and 6A are respectively similar to FIGS. 2, 3 and 3A showing another type of a deterrent structure according to the invention;

FIGS. 7, 8 and 8A depict another type of a deterrent structure according to the invention;

FIGS. 11, 12 and 12A illustrate another form of a deterrent structure according to the invention;

DESCRIPTION OF PREFERRED EMBODIMENTS

Figure 1:
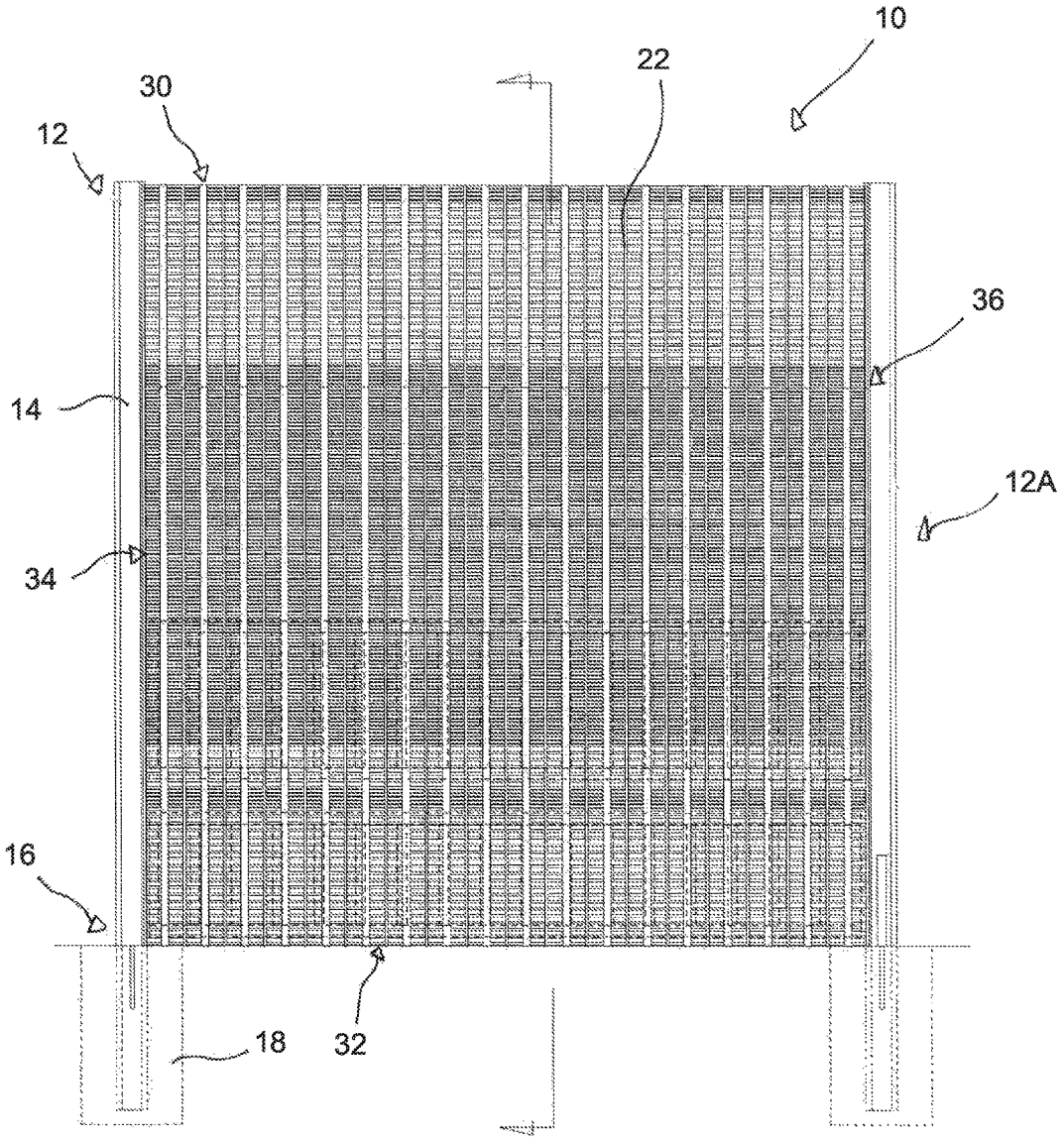
FIG. 1 is a view in elevation of a part of a barrier according to one form of the invention.

FIG. 1 of the accompanying drawings is a view in elevation illustrating a portion of a barrier 10 according to the invention. The barrier includes a plurality of elongate vertically extending supports 12 (only two are shown in FIG. 1) which are positioned at spaced apart intervals. Each elongate support 12 comprises a respective elongate tubular member 14 which extends vertically and which has a lower end 16 which is embedded, in a cementitious mix 18 in the ground, at a defined position on a barrier line 20.

A first mesh panel 22 is positioned between and secured to a pair of the adjacent supports 12 and 12A. The first mesh panel 22 has a horizontal upper edge 30, an opposed horizontal lower edge 32, a first vertical edge 34 with a flange 34A, and a second vertical edge 36 with a flange 36A (not shown). The flanges 34A and 36A are attached to the supports 12 and 12A respectively using suitable security fasteners.

A similar arrangement is adopted between each pair of adjacent supports 12.

The first mesh panel 22 (see FIG. 2 which shows the panel 22 from one side) is formed with a number of V-shaped reinforcing formations 40A, 40B, 40C and 40D. Each reinforcing formation extends horizontally between the vertical edges 34 and 36 of the panel. The formations 40A to 40D, which are parallel to and vertically spaced apart from one another, are formed under factory conditions by bending the mesh material from which the panel 22 is made.

A deterrent structure 42 is attached to the first mesh panel 22. The deterrent structure 42, in this example, includes three substantially identical mesh panels 44A, 44B and 44C respectively which are shaped to fit between adjacent reinforcing formations 40A and 40B, 40B and 40C, and 40C and 40D, respectively, as is shown in FIG. 3. Each panel 44A to 44C extends between the adjacent posts 12 and 12A. As shown in an insert drawing FIG. 3A, each panel 44A to 44C optionally includes a reinforcing flat bar strip 46 which is welded to mesh 48 embodied in the respective panel and, at each vertical edge, the panel 44A to 44C has a respective flange 50 which extends over a surface of the respective post 12 or 12A, as the case may be.

Figure 4:
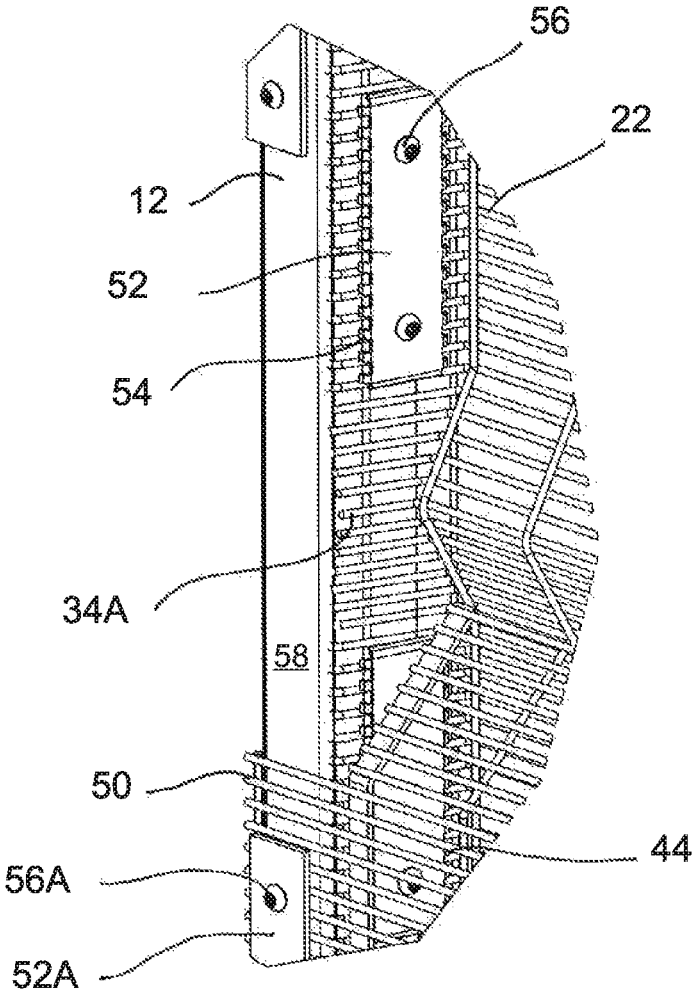
FIG. 4 shows an attachment arrangement which can be adopted for use with the deterrent structure.

FIG. 4 illustrates, in further detail, an attachment arrangement adopted at each of the posts 12 and 12A. The first vertical flange 34A of the first mesh panel 22 is brought into close-fitting abutment with the support 12 which comprises an elongate vertically extending tubular member 14. Bearing plates 52 with hook-shaped edges 54 are placed over the flange 34A and are secured to the support 12 using anti-theft fasteners 56.

The respective flange 50 of each second panel 44A to 44C overlies at least a part of a surface 58 of the support 12. The panel (44A to 44C) is secured to the support 12 using bearing plates 52A and fasteners 56A generally in the manner which has been described in respect of the first mesh panel 22.

The attachment arrangement shown in FIG. 3 is on a protected side of the barrier. Each panel 44A to 44C has sloping, horizontally extending flanges 60 and 62 respectively at its upper and lower edges. The panel 44A is dimensioned so that when the panel is secured in position edges 64 and 66 of the flanges 60 and 62 respectively are close to a junction of the horizontally extending reinforcing formation 40A and an adjacent vertically extending mesh section 70, and to a junction of the horizontally extending reinforcing formation 40B and the mesh panel section 70 respectively. A similar observation applies to the panels 44B and 44C.

FIG. 3 shows the so-called "attack" side of the fence on the right of the barrier 10. The "protected" side 74 is shown to the left of the barrier. The reinforcing formations 40A to 40C present a plurality of angled surfaces which make it difficult for an intruder to use these reinforcing formations to gain a foothold or handhold to climb over the fence. The same technique is adopted on the protected side 74 in that the sloping surfaces 60 of the panels 44A to 44C and the sloping surfaces 72 of the reinforcing formations 40A to 40C do not afford an intruder a meaningful foothold or handhold which could assist the intruder in climbing over the barrier.

Figure 2:
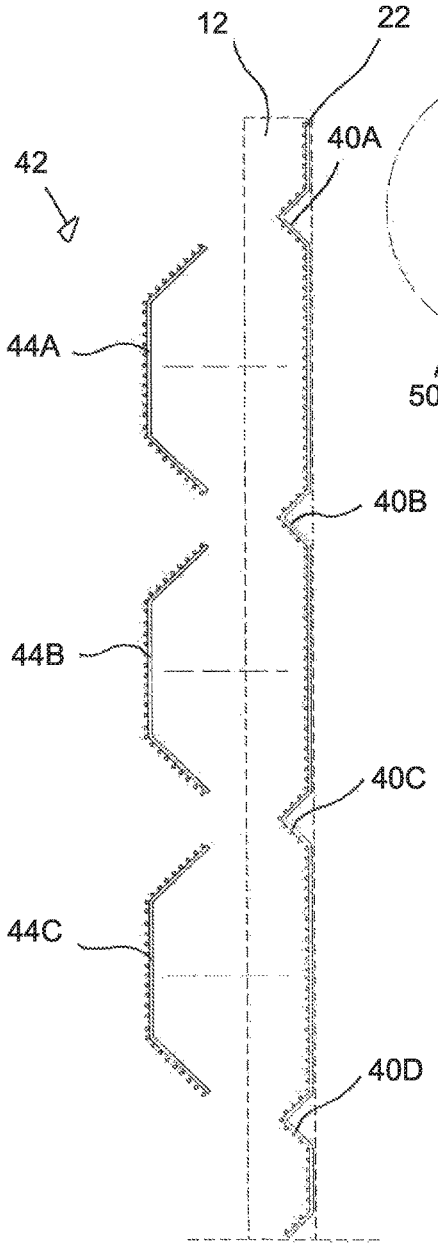
FIGS. 2, 3 and 3A illustrate one type of a deterrent structure which can be used with a barrier of the kind shown in FIG. 1.
Figure 3A:
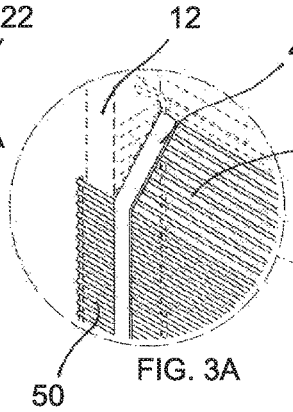
Figure 3:
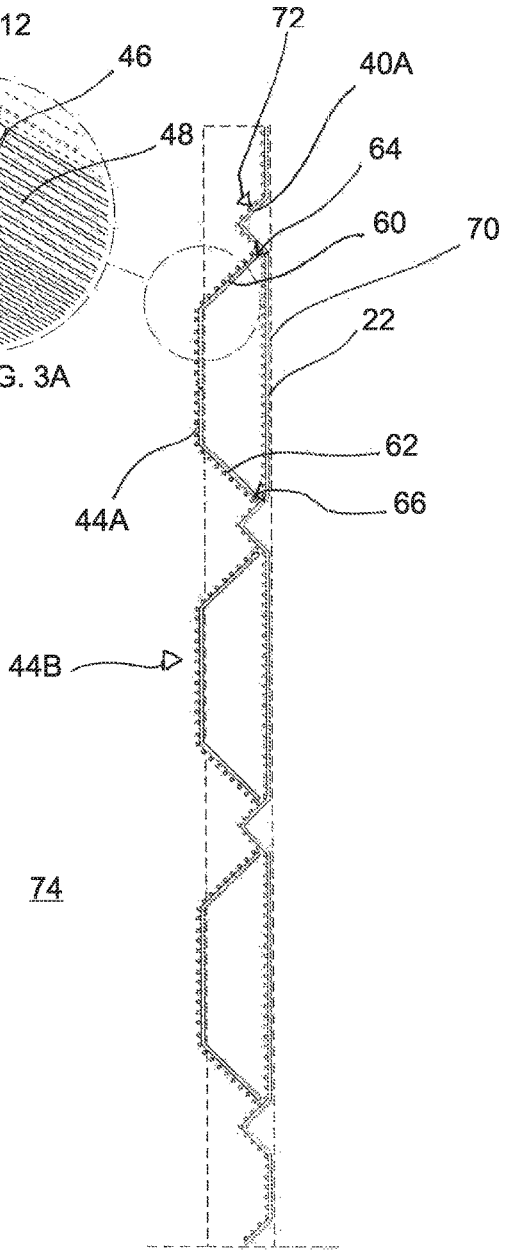

FIGS. 5, 6 and 6A show of a barrier 10A which is similar in many respects to the barrier shown in FIGS. 2, 3 and 3A. For this reason like reference numerals are used to designate like components. A difference, however, lies in the fact that each support 12 includes a respective second elongate tubular member 14A which preferably, is embedded in the ground or, alternatively and additionally, is directly fixed to the existing tubular member 14 (in the case in which an existing barrier is being upgraded).

A deterrent structure 82, which is used in place of the deterrent structure 42, includes a plurality of panels 84A, 84B and 84C which are similar to the panels 44A to 44C. However, the panels 84A to 84C have flanges 90 which are bent through 90° relative to what is shown in FIG. 4. Thus the flanges 90 can be brought into abutment with a side surface 92 of the additional tubular member 14A, as is shown in FIG. 6A, and can then be secured to this surface using appropriate bearing plates 94 and fasteners 96.

FIG. 7 shows the barrier 10 from one side and a deterrent structure 100 displaced from the barrier 10. FIG. 8 shows the deterrent structure 100 engaged with the barrier 10.

The deterrent structure 100 comprises a large panel 102 with upper and lower sloping horizontally extending flanges 104 and 106 respectively. The panel 102 overlies intermediate horizontally extending reinforcing formations 40B and 40C respectively in the first mesh panel 22. Edges 104A and 106A of the flanges 104, 106 are respectively in abutment with the junctions of the reinforcing formation 40A and an adjacent vertically extending mesh panel section 108 and a junction of a vertically extending mesh panel section 110 and the horizontally extending reinforcing formation 40D, of the first mesh panel 22. This is done for the reasons which have been alluded to.

Figure 9:
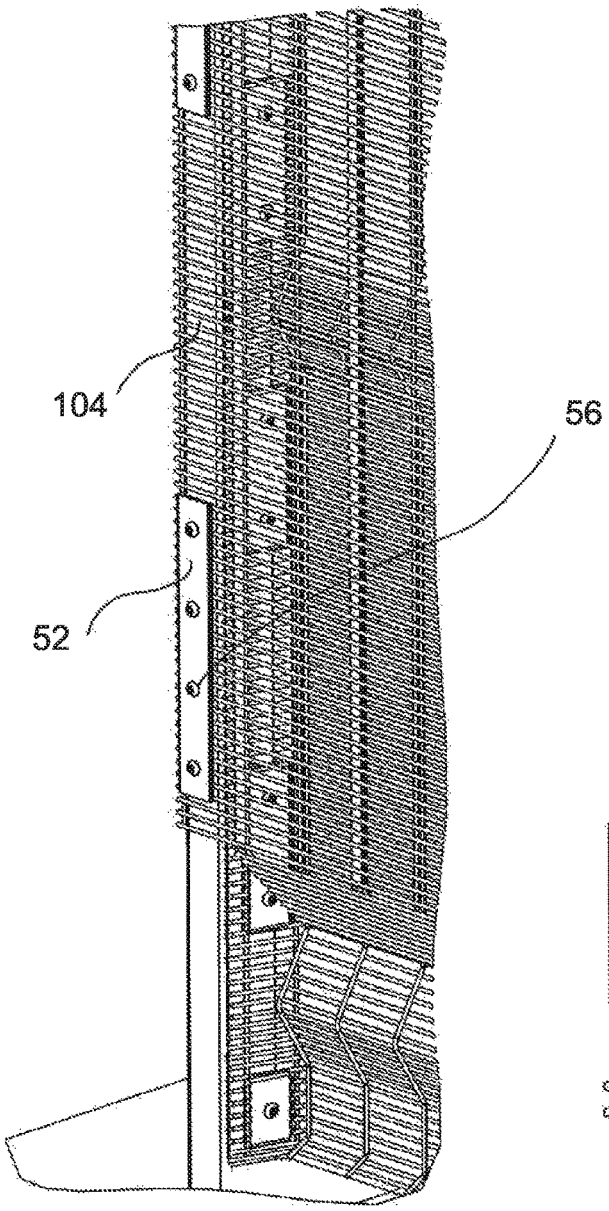
FIGS. 9 and 10 show details of fastening arrangements for use with the deterrent structure of FIGS. 7 and 8.
Figure 10:
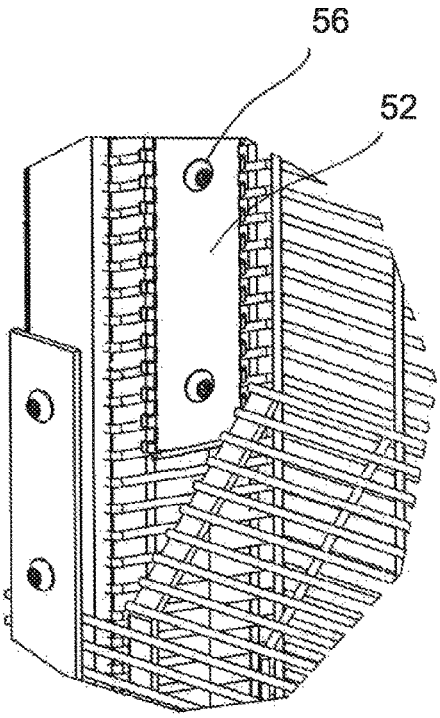

The panel 102 has opposed planar flanges 114 at its vertical edges (only one flange is shown in FIG. 8A). Each flange 114 overlies a surface 116 of the respective tubular member 14 and is secured thereto in the manner illustrated in FIGS. 9 and 10 in that use is made of bearing plates 94 which overlie the flanges and suitable anti-theft fasteners 96 which fix the bearing plates and the flanges directly to the vertically extending tubular members 14.

Figures 11, 12:
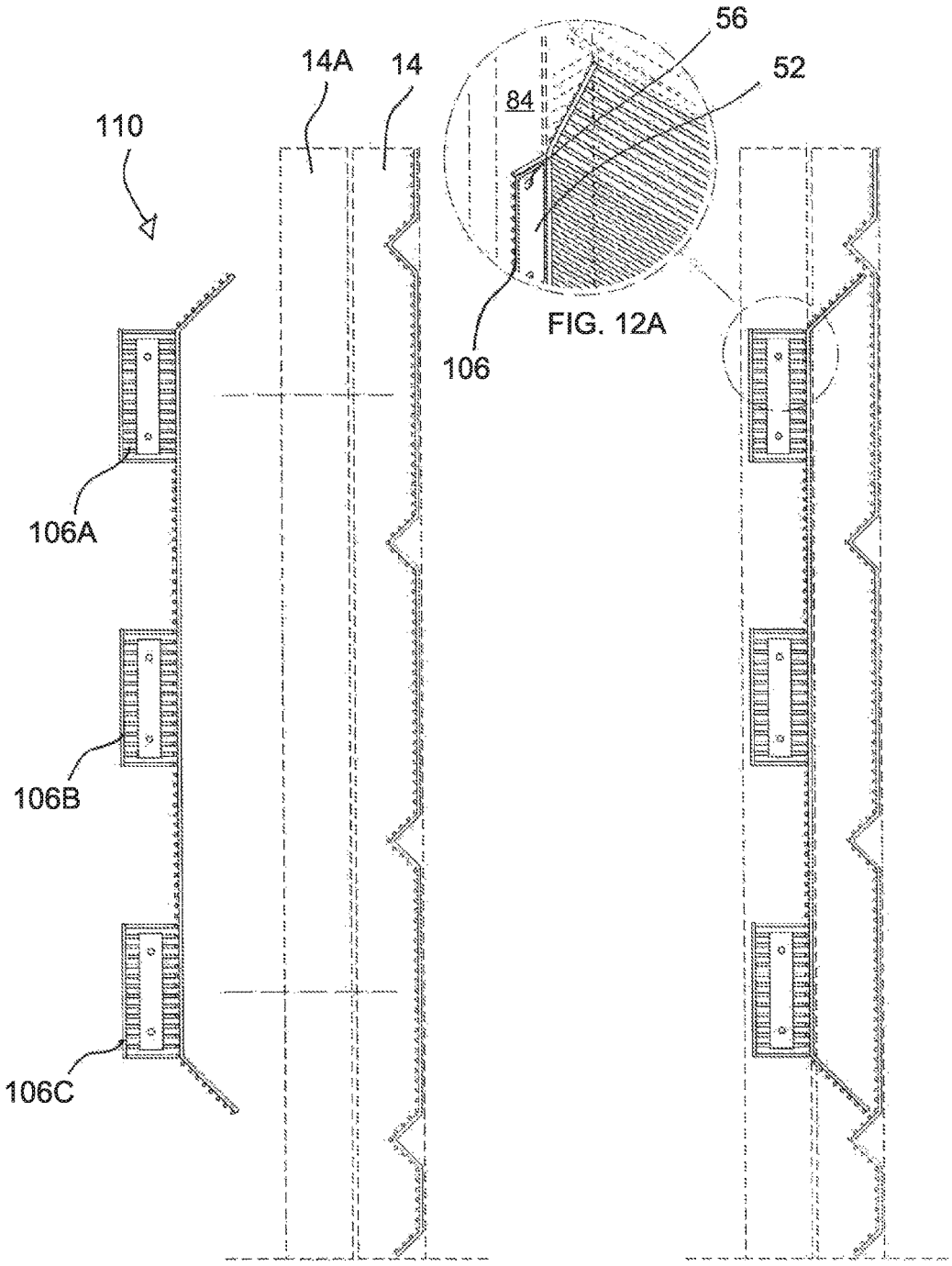

FIGS. 11, 12 and 12A show aspects of a deterrent structure 122 which, in one respect, may be regarded as a combination of the arrangements shown in FIGS. 7 and 8, and in FIGS. 5 and 6. Each support 12 has an additional tubular member 14A in a position adjacent, and secured to, a respective vertically extending tubular member 14. Vertical flanges 124 of the panel 102 of FIG. 7 are bent through 90° and are cut to size to form flange sections 126A, 126B and 126C respectively as shown in FIGS. 11 and 12. Each flange section is then fixed to a side surface 92 of the additional tubular member 14A using bearing plates 94 and fasteners 96.

Figure 13:
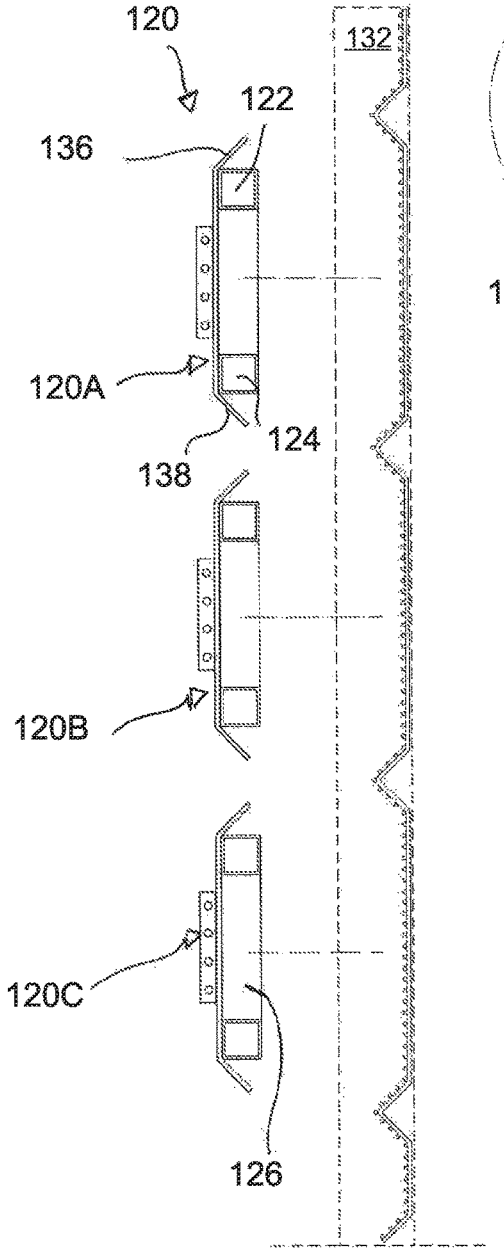
FIGS. 13, 14 and 14A show another form of a deterrent structure according to the invention.
Figure 14A:
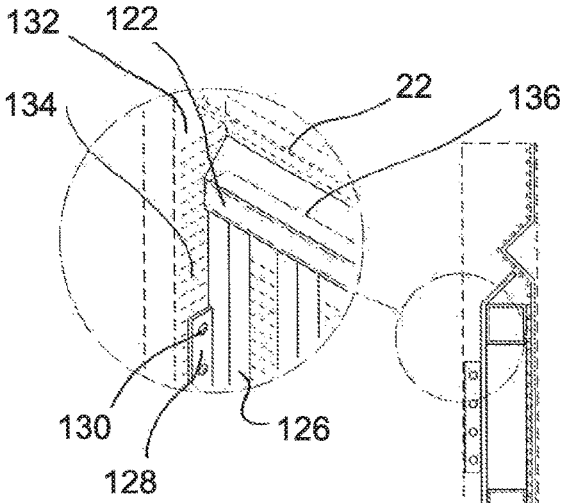
Figure 14:
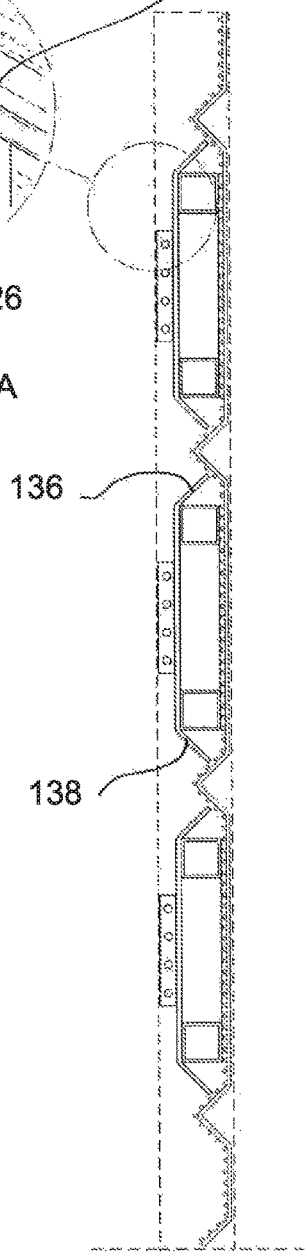

In the preceding examples the deterrent structures are based on the use of additional sections formed from a mesh material which is the same as the mesh material embodied in the first mesh panel 22. FIGS. 13, 14 and 14A illustrate a different type of a deterrent structure 140.

The deterrent structure 140 includes three components 140A, 140B and 140C which are substantially identical to each other. Each deterrent component includes horizontally extending tubular elements 142 and 144 respectively and vertically extending tubular elements 146 which are spaced apart from one another in a horizontal sense. Opposing ends of the elements 146 are welded to respective surfaces of the elements 142 and 144. The elements 146, at opposed vertical edges of the structure 140, are fixed via a respective bearing plate 148 and fasteners 150 to a side 152 of a tubular member 14. The bearing plates 148 overlie flanges 34 of the first mesh panel 22.

Flat bar strips 156 and 158 respectively, inclined to the vertical, are welded in position to the horizontally extending tubular elements 142 and 144 respectively to ensure that no surfaces, which provide a foothold or handhold to an intruder attempting to scale the barrier, are presented by the deterrent structure.

Figure 15:
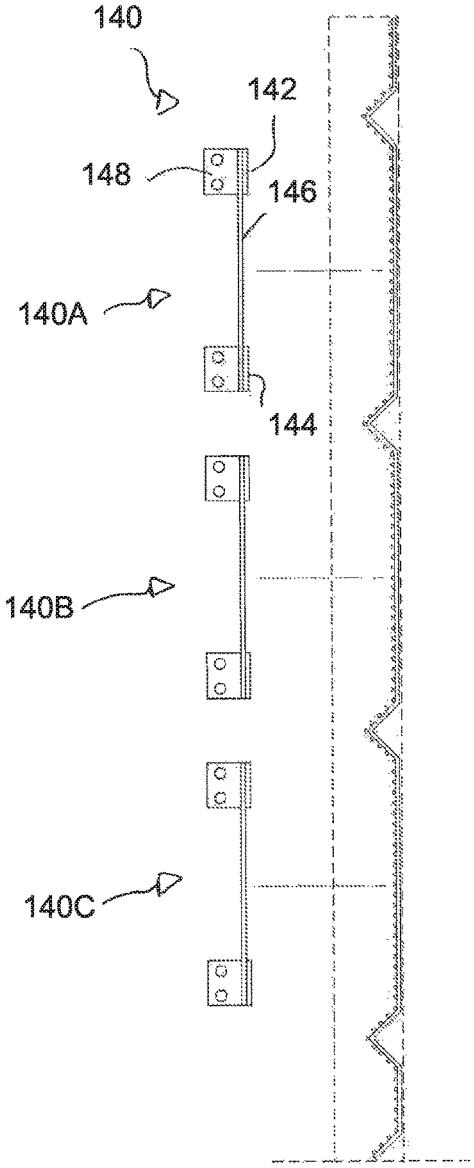
FIGS. 15, 16 and 16A show another form of a deterrent structure.
Figure 16A:
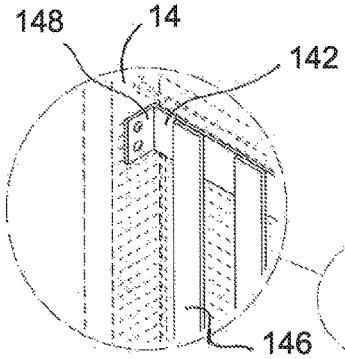
Figure 16:
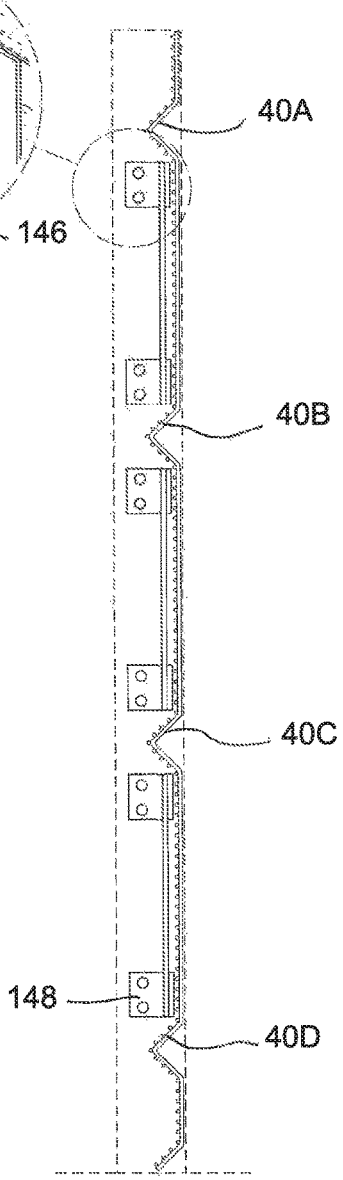

FIGS. 15, 16 and 16A show aspects of deterrent structures 160A, 160B and 160C made up from horizontally extending flat bar sections 162 and 164 respectively and spaced apart vertically extending flat bar elements 166 which are welded to the sections 162 and 164 at spaced apart intervals. Small flanges 168 at opposing ends of the sections 162 and 164 provide a means whereby the deterrent structures 160A, 160B and 160C can be attached directly to the tubular members 14. In each case the structures 160A, 160B and 160C are positioned between an adjacent pair of horizontally extending reinforcing formations 40A and 40B, 40B and 40C, and 40C and 40D, respectively.

Figure 17:
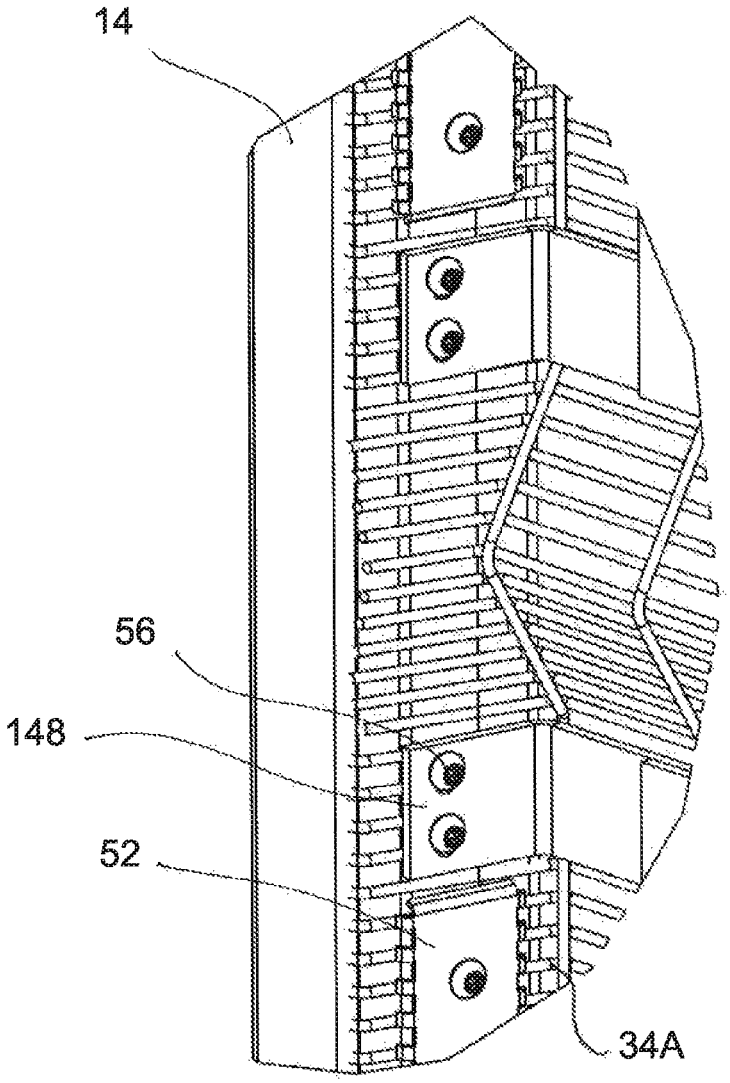
FIG. 17 illustrates details of a fastening arrangement for use with the deterrent structure of FIGS. 15 and 16.

FIG. 17 illustrates in detail the fastening arrangement referred to in connection with FIGS. 15 and 16. Load spreading or bearing plates 170 with fasteners 172 are used to fix a vertically extending flange 34A of the first mesh section 22 to the vertically extending tubular members 14 which are included in the supports 12. The small flanges 168 overlie the mesh flanges 34A and are also directly fixed to the tubular member 14 using the fasteners 172.

Figure 18:
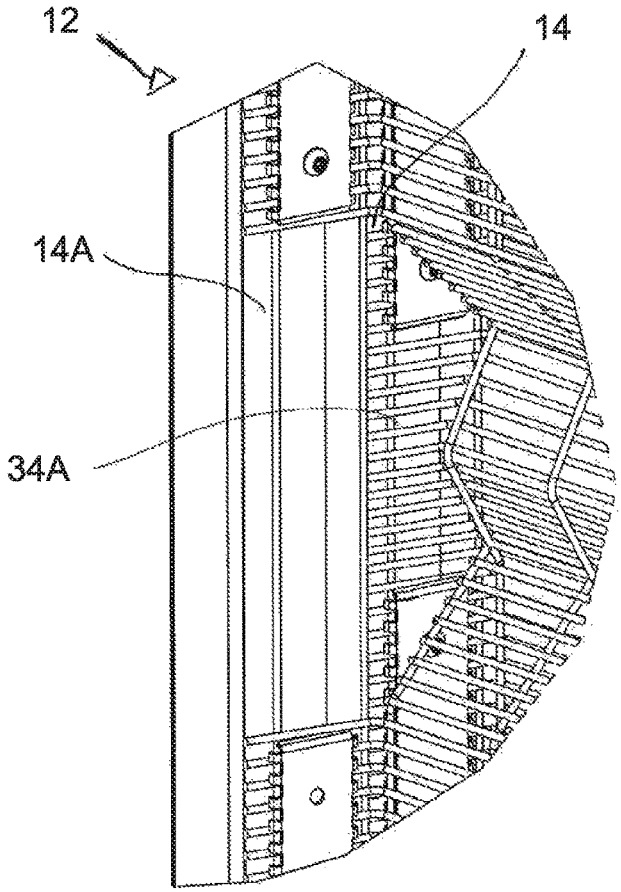
FIG. 18 is a plan view of a reinforced support arrangement for use in the barrier of the invention.

FIG. 18 illustrates in plan a support 12 which includes an elongate vertically extending tubular member 14 and an additional elongate vertically extending tubular member 14A. The member 14A may be erected at the same time as the member 14 or it may be erected subsequently—a step which can be taken if an existing fence is to be upgraded. The tubular members 14 and 14A have similar profiles in cross-section. The first mesh panel 22 has a sloping side mesh flange 34A which is directly fixed, using plates and fasteners, to a side of the tubular member 14. The flanges 90 of the structures 82 shown in FIG. 5 are fixed in a similar manner to a side of the additional tubular member 14A.

Figure 19:
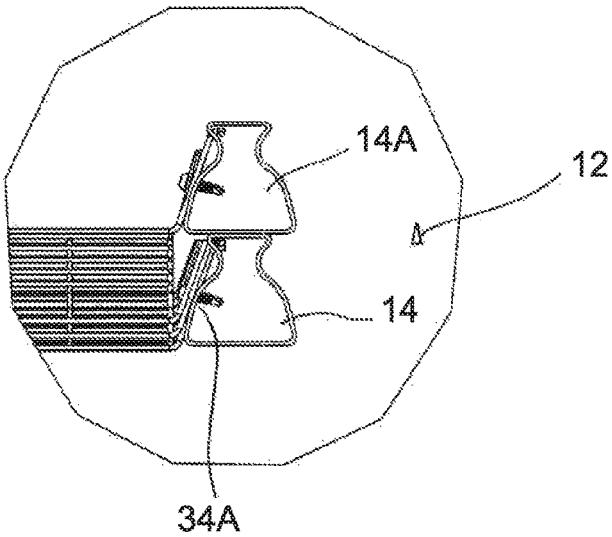
FIG. 19 shows the support arrangement of FIG. 18 from one side.

FIG. 19 illustrates from one side and on an enlarged scale the supporting arrangement which has been described in connection with FIG. 18.

Figure 20:
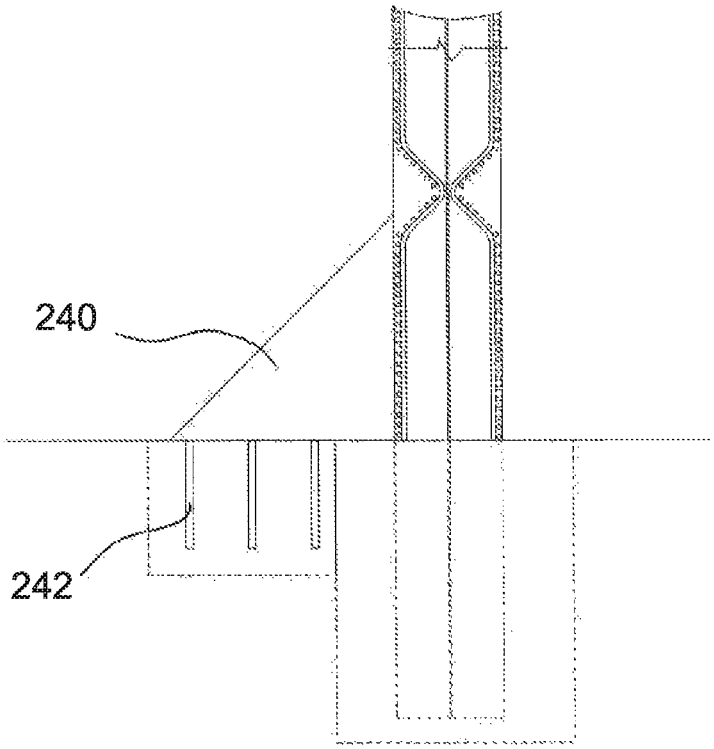
FIG. 20 illustrates from one side a base of a support and depicts how the support can be stiffened.

Various techniques have been described for upgrading the barrier. In order to strengthen each tubular member 14 an additional tubular member 14A can be used. Another technique is shown in FIG. 20. A fairly large gusset 240 of triangular form is fixed to a lower portion of the tubular member 14 and a horizontally extending lower edge of the gusset is anchored by means of ground anchors 242 to the ground. The gusset 240 could also be anchored to the ground by submerging a lower portion thereof into a cementitious mix.

Figure 21:
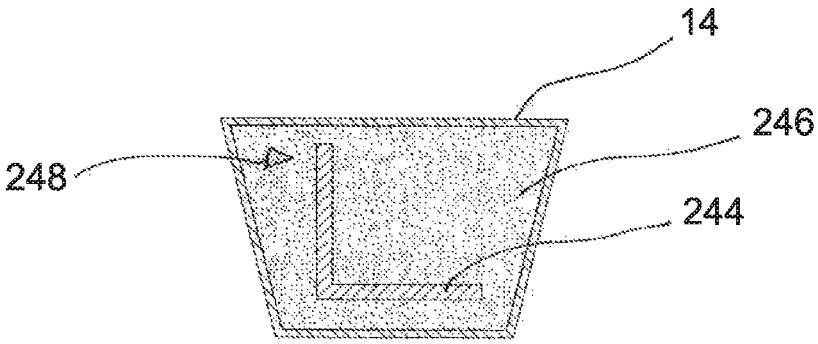
FIG. 21 shows in cross-section a reinforced tubular member which is used in a support of the barrier of the invention.

FIG. 21 shows that a singular tubular member 14 can be strengthened by placing a reinforcing element, eg. a length of angle iron 244, into the tubular member. Thereafter a settable material 246, for example of concrete, is used to fill a space 248 between the element 244 and an inner surface of the tubular member 14.

In the various deterrent structures it is important that all horizontal elements which face upwardly, typically at boundary positions, are orientated or otherwise have flat bar sections attached to them so that sloping surfaces are presented which do not constitute footholds or handholds to an intruder.

The tubular elements shown in FIGS. 13 and 14 can be further upgraded, as to their deterrent effect, by filling the elements with a cementitious or other settable mixture made, for example, from a ceramic material to enhance the capability of the tubular elements to resist attack by an angle grinder, a saw or an oxyacetylene cutting torch.

The upgrading of the barrier may thus be accomplished by the addition to an existing mesh panel or the provision, in conjunction with a mesh panel, of one or more high density welded mesh sections, flat bars or tubular deterrent structures. A composite panel may be fabricated to have ballistic resistant properties.

Smaller panels of the kind shown in FIG. 13 which are fitted between horizontally extended reinforcing formations are easy to handle and transport. Panels which are greater in a vertical length may be fitted over substantially the whole of a panel if necessary, to upgrade the deterrent characteristics of the panel.

An advantage of upgrading an existing barrier is that the bulk of the cost (of upgrading) is only incurred if circumstances change. Use is made of existing posts and foundations, and upgrading is quick and relatively easy to carry out. A user may select a specific area to be upgraded, ie. an area where the risk of intrusion is great. It is then not necessary to upgrade the entire barrier or fence. Care should be taken to avoid creating a foothold or handhold when installing the deterrent structure. In each instance an upper edge of a mesh panel or framework (whether of flat bar or tubes or the like) should present a sloping surface of at least about 45° to the vertical and must fit flush with a surface of an existing mesh panel so that no meaningful foothold or handhold is formed.

What is claimed is:

1. A barrier having a plurality of elongate vertically extending supports which are respectively spaced apart from one another along a barrier line, the barrier comprising:

a plurality of first mesh panels, wherein a respective first mesh panel is secured to and extends between a first support and an adjacent second support of the plurality of supports, the first mesh panels each having first and second vertically extending edges fixed respectively to the first and second supports and upper and lower horizontally extending edges, and in respect of each of said plurality of first mesh panels, a respective deterrent structure fabricated separately from the first mesh panels, and opposing at least a part of each of the first mesh panels and secured to at least one of the plurality of first mesh panels, and the first and second supports, wherein the first mesh panels each include a plurality of horizontally extending reinforcing formations vertically spaced apart from one another, wherein each formation is generally V- or U-shaped in cross-section, and wherein the deterrent structure is positioned between an adjacent two of the horizontally extending reinforcing formations.

2. The barrier according to claim 1, wherein the deterrent structure comprises at least a second mesh panel positioned between two of the horizontally extending reinforcing formations.

3. The barrier according to claim 1, wherein the deterrent structure comprises a plurality of second mesh panels and each second mesh panel is positioned between a respective adjacent pair of the horizontally extending reinforcing formations.

4. The barrier according to claim 1, wherein the deterrent structure comprises a second mesh panel secured in position adjacent the first mesh panel between first and second said horizontally extending reinforcing formations in the first mesh panel, and the second mesh panel overlies at least one said horizontally extending reinforcing formation in the first mesh panel.

5. The barrier according to claim 1, wherein the deterrent structure comprises a plurality of spaced lengths of flat bar secured in position adjacent the first mesh panel between a first said horizontally extending reinforcing formation in the first mesh panel and a second said horizontally extending reinforcing formation in the first mesh panel.

6. The barrier according to claim 1, wherein the deterrent structure comprises a plurality of tubular members positioned adjacent the first mesh panel and extending between two of said horizontally extending reinforcing formations in the first mesh panel.

7. The barrier according to claim 6, wherein the plurality of tubular members are respectively filled with an attack-resistant material.

* * * * *